United States Patent [19]

Barker et al.

[11] 3,931,368

[45] Jan. 6, 1976

[54] FUEL FLOW PROPORTIONING VALVE

[75] Inventors: Thomas D. Barker, Farmington; Steve R. Mueller, Ypsilanti; Clifford A. Nickel, Plymouth; Thomas A. Sweder, Allen Park, all of Mich.

[73] Assignee: Ford Motor Company, Dearborn, Mich.

[22] Filed: Feb. 4, 1974

[21] Appl. No.: 439,456

[52] U.S. Cl...... 261/36 A; 261/50 R; 261/DIG. 56; 261/DIG. 39; 137/610; 137/625.48

[51] Int. Cl.[2] ..... F02M 9/06

[58] Field of Search..... 261/DIG. 56, 36 A, 44 R, 261/DIG. 39, 50 R; 137/610, 625.48

[56] References Cited

UNITED STATES PATENTS

| | | | |
|---|---|---|---|
| 1,258,153 | 3/1918 | Shaw | 261/DIG. 56 |
| 2,052,225 | 8/1936 | Hartshorn | 261/DIG. 56 |
| 2,462,217 | 2/1949 | Oaks | 236/99 R |
| 2,720,151 | 10/1955 | Kreuttner | 137/625.48 |
| 2,759,468 | 8/1956 | Powell et al. | 261/36 A |
| 2,998,828 | 9/1961 | Hare | 137/625.48 |
| 3,350,073 | 10/1967 | Hill | 261/50 A |
| 3,426,799 | 2/1969 | Kintner | 137/625.48 |
| 3,752,451 | 8/1973 | Kendig | 261/44 R |
| 3,778,038 | 12/1973 | Eversole et al. | 261/DIG. 56 |
| 3,794,302 | 2/1974 | Diener | 261/36 A |

*Primary Examiner*—Tim R. Miles

*Attorney, Agent, or Firm*—Robert E. McCollum; Keith L. Zerschling

[57] ABSTRACT

A variable area venturi type carburetor has a movable wall that varies the venturi area. A fuel flow metering valve moves with the wall and has a flow splitter land straddled by a fuel inlet port to proportion flow of fuel under pressure to opposite sides of the land, part of the flow supplying fuel tubes to discharge fuel adjacent the venturi throat, with the remaining proportion of fuel being returned to the pump, the proportions varying as a function of the position of the splitter land and the shape of the inlet port traversed by the splitter land.

1 Claim, 5 Drawing Figures

FUEL FLOW PROPORTIONING VALVE

This invention relates in general to a motor vehicle type carburetor. More particularly, it relates to a carburetor of the variable area venturi type, and specifically to a fuel flow metering valve construction.

Variable area venturi type carburetors are known in which at least one wall is movable to vary the area and thereby change airflow capacity. In some cases, a fuel metering rod may be attached to the movable wall for cooperation with a fuel metering orifice to vary the orifice size and thereby fuel flow as the wall moves. The metering rod usually has a designed taper for providing a desired schedule of flow with changes in engine speed and load. However, the construction of such a metering rod is expensive because of the close tolerances required, and provides a flow pattern that follows generally along a parabolic curve.

This invention relates to a fuel flow proportioning valve construction that can be tailored to flow linearly or along curves other than parabolic. It relates to a valve construction that allows a constant volume fuel flow, and one that is movable with the movable wall of the venturi to always automatically deliver fuel in the correct proportions as a function of the position of the venturi wall.

It is a primary object of the invention, therefore, to provide a fuel flow proportioning valve construction for a variable area venturi type carburetor that will automatically meter fuel flow in the correct proportion as a function of the movement of the venturi wall.

It is another object of the invention to provide a valve construction of the type described above in which the valve moves with the venturi wall and meters by means of a movable fuel splitter member moving across a slot through which the fuel is delivered to the carburetor.

Figure 1:
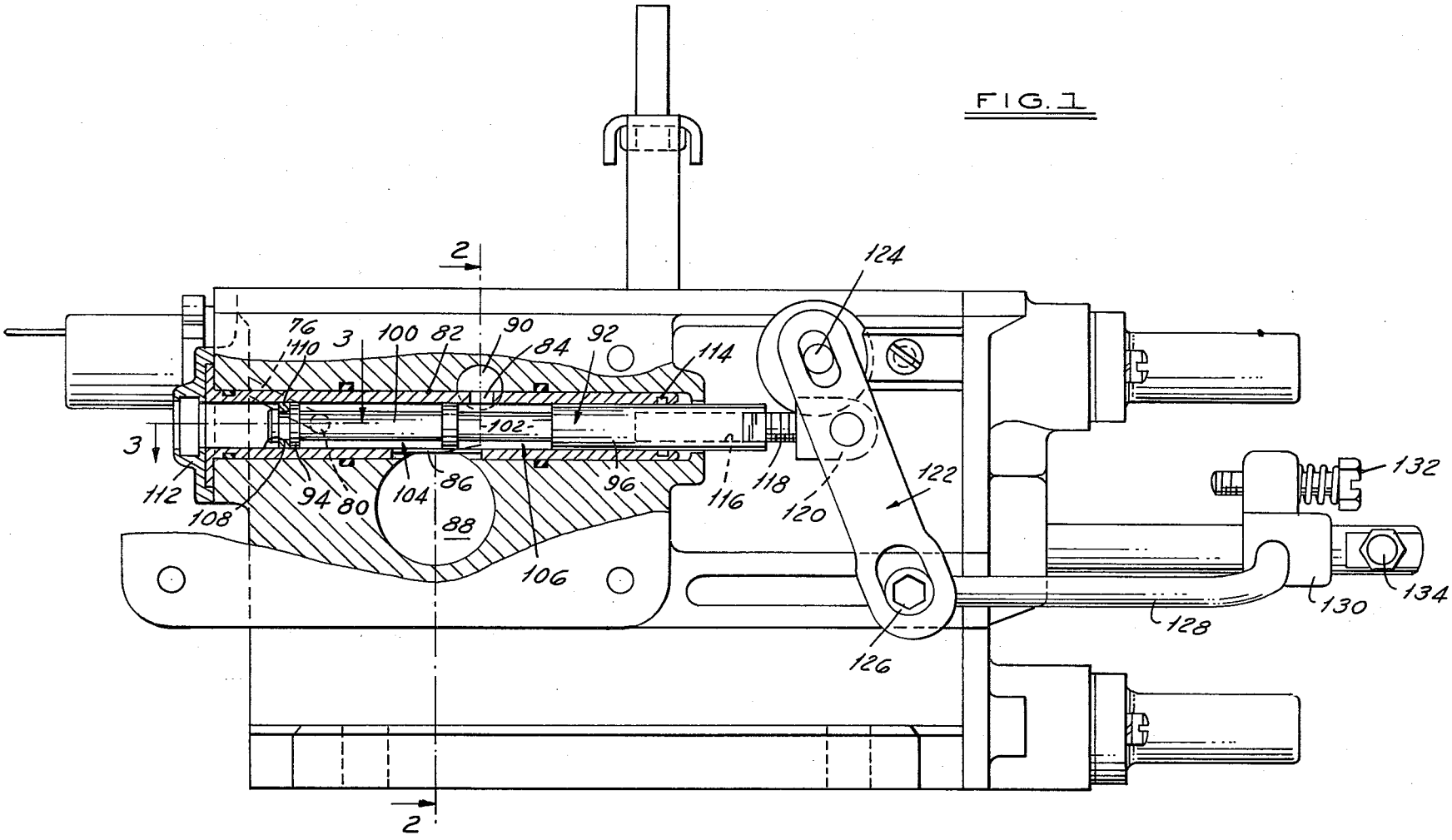
Figure 3:
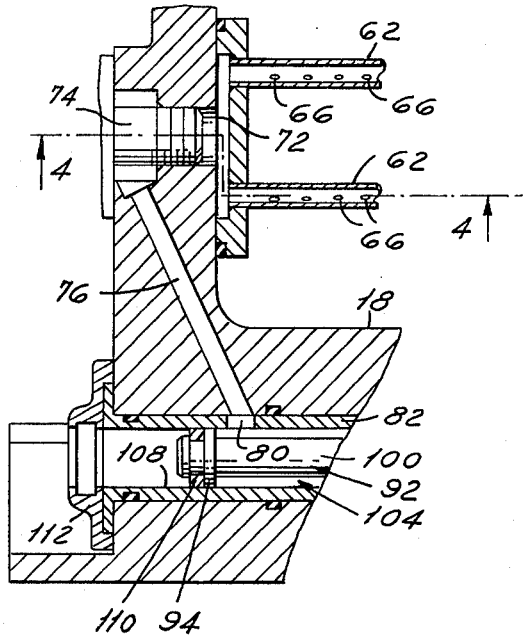
Figure 2:
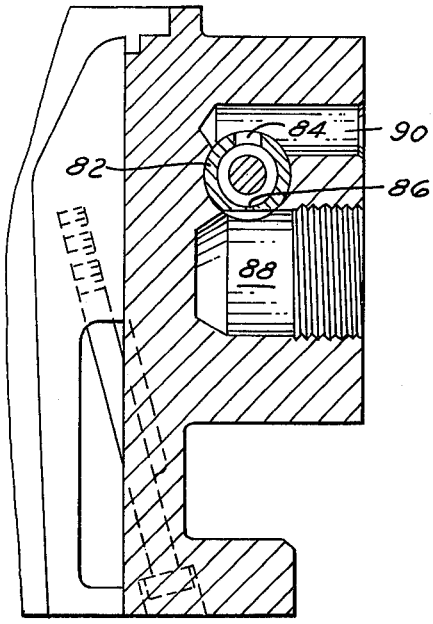
Figure 5:
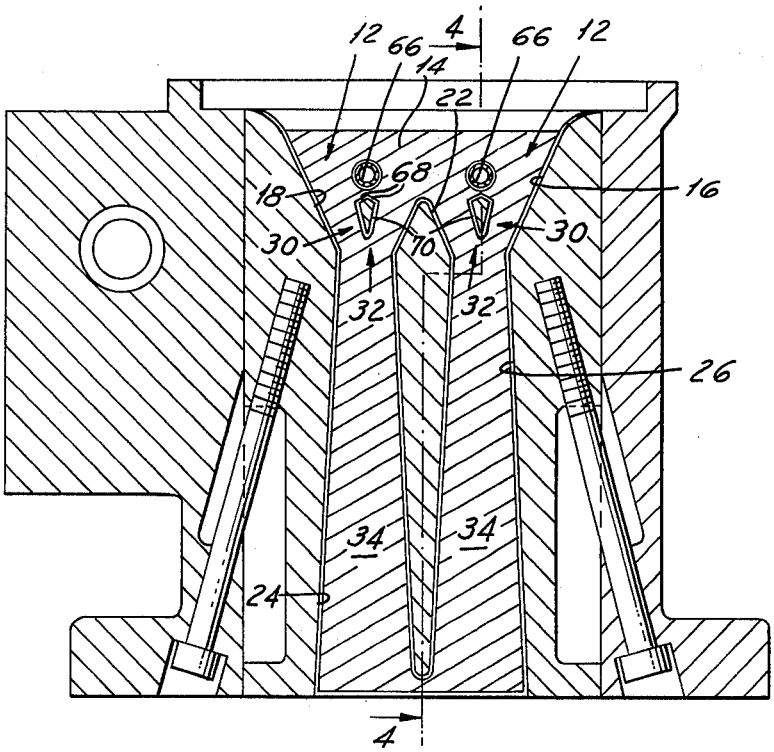
Figure 4:
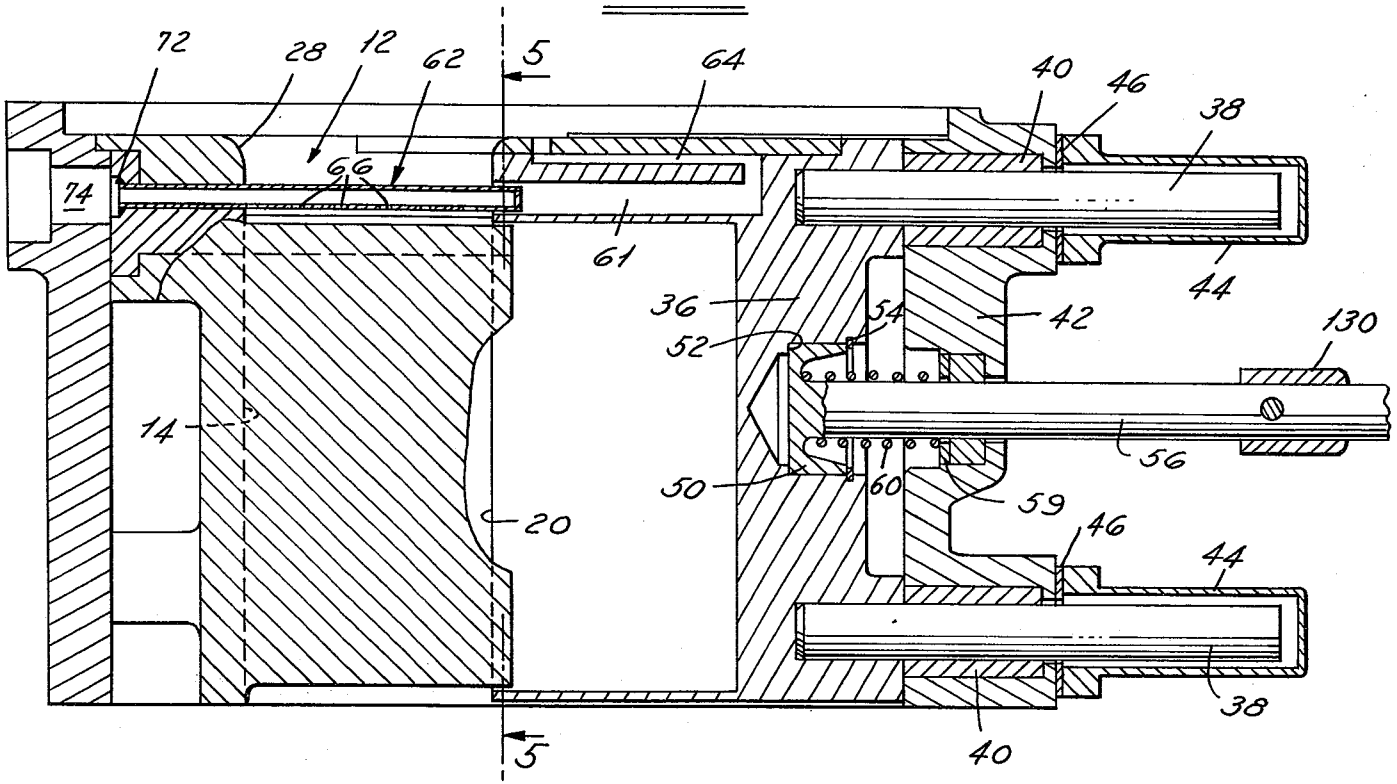

Other objects, features and advantages of the invention will become more apparent upon reference to the succeeding detailed description thereof, and to the drawings illustrating the preferred embodiment thereof, wherein:

FIG. 1 is a side elevational view, with parts broken away and in section, of a variable area venturi type carburetor embodying the invention;

FIGS. 2 and 3 are cross-sectional views taken on planes indicated by and viewed in the direction of the arrows 2—2 and 3—3, respectively, of FIG. 1;

FIG. 4 is a cross-sectional view taken on a plane indicated by and viewed in the direction of the arrows 4—4 of FIG. 5; and, FIG. 5 is a cross-sectional view taken on a plane indicated by and viewed in the direction of the arrows 5—5 of FIG. 4.

FIGS. 1, 4 and 5 show a variable area venturi type carburetor of the downdraft type. In this particular case, the carburetor has a pair of identical rectangularly shaped induction passages 12. The passages are formed by three stationary walls 14, 16 and 18 (FIG. 3), a movable end wall 20, and a stationary central partition 22. The partition divides the main opening into two bores 24 and 26 comparable to the known 2V downdraft type carburetor.

As seen in FIG. 4, the end walls 14 and 20 are rounded at the air inlet ends 28, with the main portion of the walls being essentially parallel to each other to define a constant area cross section in this plane. As seen in FIG. 5, side walls 16 and 18 each are formed in the shape of one-half of a venturi for cooperation with the matingly formed portions of the central partition 22. Each bore comprises an inlet section 30 converging towards a most constricted area or throat section 32 that joins with the diverging section 34. Thus, air inducted through the passages will increase in velocity up to a maximum at throat section 32 for fuel atomization purposes, and then be reduced in the diffuser section to a subsonic level for pressure recovery purposes, in a known manner.

As seen in FIG. 4, end wall 20 has a body portion 36 to which are secured as by a press fit a pair of guide rods or dowels 38. The latter are axially slidably mounted in a pair of bushings 40 secured within a stationary back plate 42. End vacuum covers or caps 44 are secured over the dowels to the back plate 42 with a sealing gasket 46 between to prevent leakage of vacuum.

End wall 20 is adapted to be actuated by a central piston member 50. The latter is located against a shoulder in a recess 52 in the end wall by a snap ring 54. A piston rod 56 extends slidably through a wiper type seal 58 secured in the back plate 42 by a retaining ring 59. The retaining ring 59 also serves as a seat for a return spring 60 that urges wall 20 towards the closed venturi or engine idle speed position. The rod 56 is adapted to be actuated by means to be described.

The upper portion of end wall 20 is provided with a pair of channels 61 each of which slidably receives the end of a stationary fuel bar 62. The fuel bars are telescoped more and more as the end wall 20 moves from the extreme open venturi position shown towards a smaller venturi area position. The remote end of each channel 61 is connected by an air bleed passage 64 to the atmosphere, to minimize leakage of fuel from the induction passages.

Each of the fuel bars 62 consists of a hollow tube with the lowermost portion having along its length a series of equally, axially spaced holes 66 for the discharge of fuel in a free manner from the interior of the tube. The fuel is discharged against the angled upper faces 68 of a pair of spreader bars 70 that cause the mixture to be spread across the passage throat. The end of each tube adjacent wall 20 is closed, as shown, with the opposite end connected to a fuel supply chamber 72. The chamber 72 receives fuel from a plenum 74 that is connected to a fuel pump through the fuel flow metering valve construction of the invention.

More particularly, as seen in FIG. 3, plenum 74 is connected by a passage 76 to a fuel discharge port 80. Port 80, as seen also in FIG. 1, opens through the wall of a stationary sleeve-type valve body 82. The valve body has a second fuel discharge port 84, and a large flat fuel inlet port 86. The latter is provided by the removal of a circular segment from the sleeve type valve body, resulting in a port that is rectangular in cross section. The inlet port is connected directly at all times to a fuel pump delivery passage 88, seen also in FIG. 2.

The passage 88 is adapted to receive fluid from a pump having a capacity at all times in excess of the requirements of the carburetor. Accordingly, as seen in FIG. 2, the second discharge port 84 is connected to a pump return passage 90 that bypasses fuel back to the pump inlet, in a manner not shown.

Slidably movable within valve body sleeve 82 is a fuel flow proportioning valve 92. The latter is of the spool type having a pair of opposite end lands 94 and 96 and a central fuel splitter land 98. The lands are interconnected by neck portions 100 and 102 of reduced diameter. The neck portions each define a fuel annulus or chamber 104, 106 on opposite sides of land 98, which is straddled by inlet port 86. It will be clear, therefore, that the constant volume of fuel flowing through inlet 86 will be split or divided by the land 98 to flow a portion into port 80 and the remainder into port 84, the quantity varying as a function of the position of the spool valve land 98.

The left-hand end of the spool valve, as viewed in FIGS. 1 and 3 has a stem portion provided with a groove 108 in which is mounted a wiper seal 110. This end of the valve is exposed freely to air through a cover member 112 so as not to compress air against the end of the valve. The opposite valve land 96 cooperates with another wiper seal 114 located in a groove in the valve body 82, as shown.

The right-hand end of valve 92 has a threaded hole 116 in which is screwed the end 118 of an actuator 120. The latter is pivotally connected to a movable actuating lever 122. The lever has a slotted type adjustable pivot 124 at its upper end and is pivotally connected at its lower end at 126 to an actuating rod 128. Rod 128 in turn is formed integral with a boss 130 keyed to piston rod 56 as shown in FIG. 4. Boss 130 is provided with an adjustably mounted bolt 132 that determines the idle speed position of the movable venturi wall 20, in a manner to be described. Rod 128 also has a linkage connection 134 to the vehicle accelerator pedal, not shown, for actuation in a known manner by depression or release by the driver.

In operation, the return spring 60 normally biases the venturi end wall 20 to the engine idle speed position providing the minimum area venturi, as determined by the location of stop bolt 132. Referring to FIG. 4, it will be seen that movement of wall 20 to the left will progressively cover the fuel bar outlets until only a small number of holes 66 will remain open in the idle speed position. These holes are chosen to be of a size as to not restrict the flow or in any way meter flow of fuel. During engine operation, the fuel pump will deliver fuel to valve inlet 88 completely filling the same. With the splitter land 98 in the essentially wide open throttle position shown in FIG. 1, for example, the larger portion of fuel will flow into chamber 104 and discharge through outlet 80 to the fuel bar chamber 72. At this point, the fuel will be evenly divided between the two fuel bars 62 and an equal amount of fuel will be discharged into each venturi 12. The remaining volume of fuel in inlet 86 passing into fuel chamber 106 will discharge through outlet 84 (FIG. 2) back to the inlet of the fuel pump.

As the vehicle operator releases the vehicle accelerator pedal, the piston rod 56 will be moved in a leftward direction by spring 60, as viewed in FIGS. 1 and 4, simultaneously moving the venturi end wall 20 to make smaller the venturi area. This pivots actuating lever 122 clockwise to push metering valve 92 to the left. This moves splitter land 98 proportionately to the left to decrease the volume of fuel passing through port 80 to the fuel bars 62, while proportionately increasing the volume of flow to chamber 106 and to the bypass duct 84. Thus, depending upon the position of the vehicle accelerator pedal, the metering valve 92 will be moved to the left or right, as the case may be, to decrease or increase the fuel flow to the fuel bars 62. The simultaneous movement of the venturi wall covers or uncovers more of the fuel discharge ports 66 of the fuel bars 62 to control the discharge into the venturi passages. Fuel leakage from the fuel bars out of the venturi passages is prevented in this case by the bleed of air into the channel 61 towards the venturi.

While the invention has been shown and described in its preferred embodiment, it will be clear to those skilled in the arts to which it pertains that many changes and modifications may be made thereto without departing from the scope of the invention. For example, while inlet port 86 is in this instance rectangular, and thus provides a linear flow rate with change in positions of the splitter land 98, the shape could easily be changed to say, for example, to triangular, to vary the flow rate to something other than linear, while still maintaining a nearly constant volume of flow because of the valve splitter construction.

We claim:

1. A carburetor having an air/fuel mixture passage defined in part by a variable area venturi having a movable wall to vary the area, a source of fuel under pressure, a fuel supply port connected to the source, a fuel conduit having a portion extending across the venturi adjacent the throat section thereof for cooperation with the movable wall and having a number of axially spaced fuel discharge ports uncovered progressively upon movement of the wall to enlarge the venturi, and a fuel flow spool type metering valve operably associated with the supply port and movable with the wall and constructed to meter fuel flow to the conduit as a function of the position of the valve and the wall, the construction including a hollow valve body sleeve having a circular segment removed to define a flat fuel inlet slot of predetermined axial and lateral extent communicating with the supply port, the valve being slidably movable within the sleeve and having a central land straddled by the inlet slot, the sleeve having a pair of fuel outlet ports one on each side of and spaced from the slot whereby fuel flow from the supply port through the slot is split by the land in direct proportion to the position of the land from a central null position to flow fuel in the proportioned amounts to each outlet, and means connecting one outlet to the source, and the other outlet to the fuel conduit, the supply port being maintained filled with fuel at all times to fill the inlet port to provide a predetermined schedule of fuel flow volume to opposite sides of the land as a function of the shape of the inlet port as it is traversed by the land.

* * * * *